US007886758B2

(12) United States Patent
Carter

(10) Patent No.: US 7,886,758 B2
(45) **Date of Patent: *Feb. 15, 2011**

(54) CORNER BRACE

(76) Inventor: Mark C. Carter, 1601 Iowa Ave., Riverside, CA (US) 92507

( * ) Notice: Subject to any disclaimer, the term of this patent is extended or adjusted under 35 U.S.C. 154(b) by 0 days.

This patent is subject to a terminal disclaimer.

(21) Appl. No.: 12/708,487

(22) Filed: Feb. 18, 2010

(65) Prior Publication Data

US 2010/0147346 A1 Jun. 17, 2010

Related U.S. Application Data

(63) Continuation of application No. 12/361,429, filed on Jan. 28, 2009, now Pat. No. 7,673,644, which is a continuation of application No. 11/486,503, filed on Jul. 14, 2006, now Pat. No. 7,497,227.

(51) Int. Cl.
*E04H 15/48* (2006.01)
*E04H 15/50* (2006.01)

(52) U.S. Cl. ..... 135/144; 135/131; 135/135; 135/145; 135/151; 403/171; 403/217

(58) Field of Classification Search ..... 135/131, 135/135, 143–147, 151; 403/217–219; 248/228.6, 248/229.15, 188.6, 188.91
See application file for complete search history.

(56) References Cited

U.S. PATENT DOCUMENTS

| | | | |
|---|---|---|---|
| 1,170,188 | A | 2/1916 | Rasmussen et al. |
| 1,204,329 | A | 11/1916 | Wikins |
| 1,712,836 | A | 5/1929 | Mills |
| 1,846,011 | A | 10/1929 | Adams |
| 1,853,367 | A | 4/1932 | Mace |
| 2,151,908 | A | 3/1939 | Gottlieb |
| 2,845,292 | A | 7/1958 | Dunning et al. |
| 3,942,904 | A | 3/1976 | Morris |
| 4,201,237 | A | 5/1980 | Watts et al. |
| 4,407,317 | A | 10/1983 | Crandall |
| 4,558,713 | A | 12/1985 | Hagler et al. |
| 4,601,301 | A | 7/1986 | Hermanson |
| 4,607,656 | A | 8/1986 | Carter |
| 4,641,676 | A | 2/1987 | Lynch |
| 4,779,635 | A | 10/1988 | Lynch |

(Continued)

FOREIGN PATENT DOCUMENTS

| | | |
|---|---|---|
| AU | 000025649 | 11/1987 |

(Continued)

*Primary Examiner*—Winnie Yip
(74) *Attorney, Agent, or Firm*—Fulwider Patton LLP

(57) ABSTRACT

The corner brace of a framework of a quickly erectable canopy shelter is connected between portions of a perimeter truss assembly connected to a leg of the framework of the canopy shelter. The corner brace includes a corner brace mounting pin on a first link member of an outer truss of the perimeter truss assembly, and a support truss tube member pivotally and rotatably connected at one end to an outer truss on one side of the leg. The other end of the support truss tube member is removably connected to an outer truss on the other side of the leg. The support truss tube member of the corner brace may include a support truss clip that fits to a link member of the framework. The framework may also include a canopy framework support assembly for supporting a canopy.

9 Claims, 12 Drawing Sheets

U.S. PATENT DOCUMENTS

| | | | | |
|---|---|---|---|---|
| 4,947,884 | A | 8/1990 | Lynch | |
| 5,022,420 | A | 6/1991 | Brim | |
| 5,035,253 | A | 7/1991 | Bortles | |
| 5,244,001 | A | 9/1993 | Lynch | |
| 5,274,980 | A | 1/1994 | Zeigler | |
| 5,275,188 | A | 1/1994 | Tsai | |
| 5,638,853 | A | 6/1997 | Tsai | |
| 5,701,923 | A | 12/1997 | Losi | |
| 5,771,651 | A | 6/1998 | Shiina | |
| 5,944,040 | A | 8/1999 | Jang | |
| 6,035,877 | A | 3/2000 | Losi | |
| 6,601,599 | B2 | 8/2003 | Carter | |
| 6,651,942 | B1 * | 11/2003 | Yardley et al. | 248/100 |
| 6,772,780 | B2 | 8/2004 | Price | |
| 6,779,538 | B2 | 8/2004 | Morgante et al. | |
| 6,848,461 | B2 | 2/2005 | Tsai | |
| 6,874,520 | B2 | 4/2005 | Carter | |
| 7,168,439 | B2 | 1/2007 | Patel et al. | |
| 7,367,348 | B2 | 5/2008 | Tsai et al. | |
| 2002/0092555 | A1 | 7/2002 | Chen et al. | |
| 2002/0189659 | A1 | 12/2002 | Carter | |
| 2005/0016573 | A1 | 1/2005 | Wu | |
| 2007/0221263 | A1 * | 9/2007 | Tai | 135/145 |

FOREIGN PATENT DOCUMENTS

| | | |
|---|---|---|
| EP | 1138852 | 10/2001 |
| GB | 002258475 | 10/1993 |
| GB | 002320509 | 6/1998 |
| JP | 406299735 | 10/1994 |
| JP | 11062323 | 3/1999 |
| JP | 2003227249 | 8/2003 |
| JP | 2005290837 | 10/2005 |
| WO | WO9313284 | 7/1993 |

* cited by examiner

CORNER BRACE

RELATED APPLICATIONS

This application is a continuation of application Ser. No. 12/361,429 filed on Jan. 28, 2009, now U.S. Pat. No. 7,673,644, which is a continuation of Ser. No. 11/486,503, filed Jul. 14, 2006, now U.S. Pat. No. 7,497,227.

BACKGROUND OF THE INVENTION

This invention relates generally to folding, collapsible structures, and more particularly relates to a corner brace for a framework of a canopy shelter.

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One known quickly erectable, collapsible shelter includes a framework of X-shaped linkages, telescoping legs, and a canopy covering the framework. The legs of that shelter are capable of telescoping to about twice their stowed length, and the framework of X-shaped truss pairs is capable of horizontal extension between the legs to support a canopy. The framework can be constructed of lightweight material, and the telescoping legs can be extended to raise the framework of the shelter.

In order to increase the portability and versatility of such temporary shelters, it is important that they be not only lightweight and small enough in a folded, compact configuration so that can be readily transported and carried, but also large enough and with sufficient headroom when unfolded for a group of people to stand underneath them. As such structures have become larger and more lightweight, reinforcing features that contribute to strength, roominess, and ease of use in setting up and taking down such structures have also become increasingly important.

One modern type of tent structure provides a lightweight roof structure with four roof rods joined together at the center by a head connector member, with each of the roof rods formed of two rod members interconnected by intermediate pivot connecting members. The roof rods are supported on top of a base structure formed by four legs and scissors-type linkages connected to a top fixed connector and a lower sliding connector of each leg. Each intermediate pivot connecting member between the individual rod members of the roof rods confines upward rotation of the rod members to an uppermost, upwardly arching position, but allows the roof rods to be folded downwardly when the tent is collapsed. Reinforcing linking rods provided at the corners of the roof structure are coupled at one end to the lower sliding connectors on the legs, and are slidably coupled at the other end to the roof rods, to assist in stabilizing the roof rods in the upwardly arched position when the shelter is fully unfolded and extended. However, the sliding coupling of the corner linking rods must slide over a considerable length of the roof rods which can lead to abrasion and wear of the roof rods and eventually interfere with the sliding of the linking rods during setting up and taking down of the structure, without providing any significant reinforcing strength or vertical support of the roof structure when the shelter is fully unfolded and extended.

Lightweight shelters with raised roof structures are particularly useful for holding gatherings in inclement weather, to provide needed headroom and shed precipitation and debris, but raised roof structures can be particularly vulnerable to downward forces placed on a roof structure by strong winds. One approach to providing a lightweight shelter with a raised roof structure has been to make the roof structure flexible so that it can move between a raised, upwardly arching configuration when weather permits, and a lowered, downwardly arching configuration if the downward force of the wind is sufficiently strong, to automatically present a reduced profile to strong winds when necessary. However, there remains a significant problem for collapsible shelters that have a clear span across a middle portion of the perimeter truss assembly that is not directly connected to and supported by a leg. There thus remains a need for improved strength of the canopy on such unsupported sides of the canopy, to help prevent the unsupported sides from caving in due to heavy loading from strong winds. The present invention meets these and other needs.

SUMMARY OF THE INVENTION

Briefly and in general terms, the present invention provides for a corner brace for a framework of a quickly erectable canopy shelter, in which the corner brace is connected between portions of a perimeter truss assembly about a leg of the framework of the canopy shelter, to provide improved strength and stability for a canopy shelter having a clear span across a middle portion of the perimeter truss framework of the canopy shelter that is not directly supported by a leg.

The present invention accordingly provides a corner brace assembly for a framework of a quickly erectable canopy shelter, the framework of the canopy shelter including a leg and a perimeter truss assembly connected to a leg having an upper end and a lower end, and a slider member slidably mounted to the leg. The perimeter truss assembly includes first and second outer trusses of pairs of link members connected to the leg, each pair of link members of the first and second outer trusses including a first link member and a second link member pivotally connected together, the first link member having an outer end pivotally connected to the upper end of the leg, and the second link member having an outer end pivotally connected to the slider member.

The corner brace assembly includes a corner brace mounting pin mounted to and extending from the first link member of the second outer truss; and a corner brace member. In one presently preferred aspect, the corner brace mounting pin includes an enlarged head spaced apart from the second outer truss. The corner brace member includes a support truss tube member pivotally connected to a support truss swivel bracket that is rotatably connected to an outer section of the first link member of the first outer truss on one side of the leg for rotational movement with respect to the first link member. The second end of the support truss tube member includes a support truss end fitting removably connected to an outer section of the first link member of the second outer truss on the other side of the leg, and the support truss end fitting includes a slot for removably receiving the corner brace mounting pin, to removably connect the first and second outer trusses together. In a presently preferred aspect, at least one of the outer trusses of pairs of link members is connected to a middle truss pair of link members. In another presently preferred aspect, the support truss tube member of the corner brace includes a support truss clip adapted to snap fit to one of the link members of the framework of the canopy shelter.

In another presently preferred aspect, the framework of the canopy shelter includes a canopy framework support assembly including a peak beam member having an inner end and an outer end pivotally mounted to the leg to extend across the shelter. The peak beam member typically includes an inner peak beam tube section and an outer peak beam tube section pivotally joined together through an over-center spacer. In a presently preferred aspect, the over-center spacer includes a locking flange allowing the inner peak beam tube section to rotate about the over-center spacer to an extended position braced against the locking flange. In another preferred aspect, the inner end of the peak beam member may be pivotally connected to a central peak hub assembly.

In another preferred aspect, the framework for the canopy shelter may also include a support strut member having an outer end pivotally mounted to the slider member below the peak beam member, and an inner end of the support strut member pivotally connected to the peak beam member to support the peak beam member.

Other features and advantages of the present invention will become more apparent from the following detailed description of the preferred embodiments in conjunction with the accompanying drawings, which illustrate, by way of example, the operation of the invention.

DETAILED DESCRIPTION OF THE PREFERRED EMBODIMENTS

Figure 1:
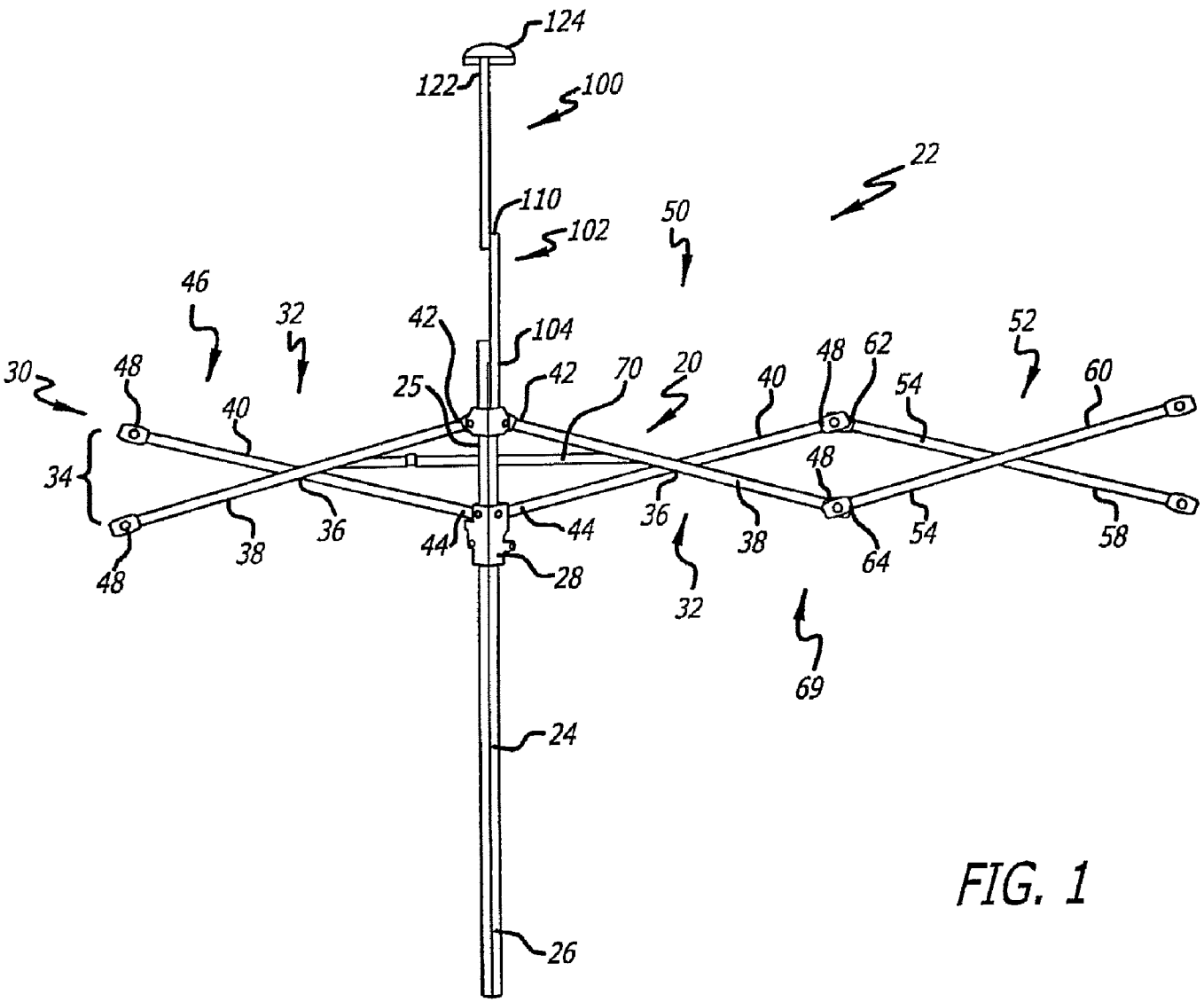
FIG. 1 is an outside elevational view of a corner portion of a framework of a canopy shelter, illustrating the corner brace according to the invention.
Figure 2:
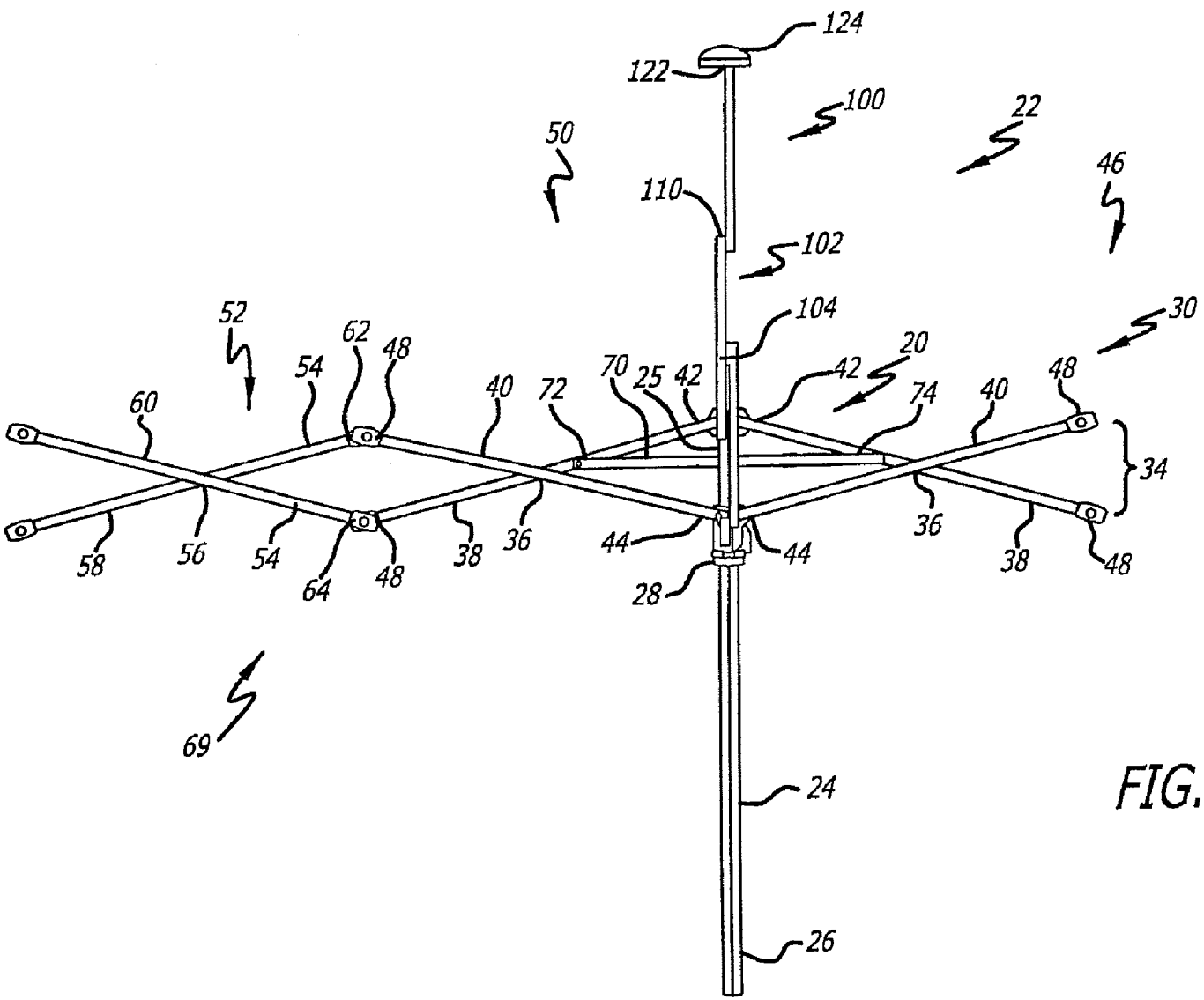
FIG. 2 is an inside elevational view of the corner portion of a framework of a canopy shelter of FIG. 1.

While lightweight canopy shelters have been developed with raised roof structures and large spans suitable for holding gatherings in inclement weather, there remains a significant problem of instability due to heavy loading from strong winds for such canopy shelters that have a wide span across a middle portion of the perimeter truss assembly that is not directly connected to and supported by a leg.

As is illustrated in the drawings, the present invention accordingly provides for a corner brace assembly 20 for a framework 22, only a portion of which is shown, of a quickly erectable canopy shelter, typically including a perimeter truss framework and a central truss framework, which is connected to legs of the canopy shelter to stabilize and support the collapsible shelter, as is described in U.S. Pat. No. 5,490,533, which is incorporated by reference herein. Referring to FIGS. 1-4, the corner brace assembly is typically provided at a portion of the perimeter framework connected to a leg 24 having upper end 25 and lower end 26. The framework of the canopy shelter preferably has four legs, but can also have three, five, or more legs. A slider member 28 is typically slidably mounted to the leg, such as at an upper section of the leg. The extendible perimeter assembly 30 of link members connecting legs of the framework together typically includes X-shaped outer trusses 32 formed of pairs of link members 34 that are pivotally connected together at pivot point 36. The pairs of link members include first link member 38 and second link member 40. The first link member has an outer end 42 pivotally connected to the upper end of a leg, and the second link member having an outer end 44 pivotally connected to the slider member. The first and second link members are thus connected together in a scissors configuration so as to be extendable from a first collapsed position extending horizontally between pairs of legs to a second extended position extending horizontally between the pairs of legs, as is described in U.S. Pat. No. 5,490,533.

Referring to FIGS. 1-4, on at least one side 46 of the framework of the canopy shelter such an X-shaped outer truss may connected to another X-shaped outer truss at their inner ends 48, or may be connected to an adjacent leg, and on another side 50 of the framework of the canopy shelter forming a wide, clear span across the middle of the framework, the extendible perimeter assembly of link members may also include one or more X-shaped middle trusses 52 not directly connected to the legs, and only supported by the outer trusses. The middle truss is similarly formed by a pair of link members 54 pivotally connected together at pivot point 56, and includes a first link member 58 and a second link member 60. The first link member of the middle truss has a first end 62 pivotally connected to the inner end of the second link member of the adjacent outer truss, and the second link member of the middle truss has a first end 64 pivotally connected to the inner end of the first link member of the adjacent outer truss. The middle truss is thus similarly formed in a scissors configuration so as to be extendable from a first collapsed position extending horizontally between pairs of legs to a second extended position extending horizontally between the pairs of legs, as is described in U.S. Pat. No. 5,490,533. The middle truss may be connected to another middle truss at their inner ends 66, or may be connected to another outer truss.

Figure 3:
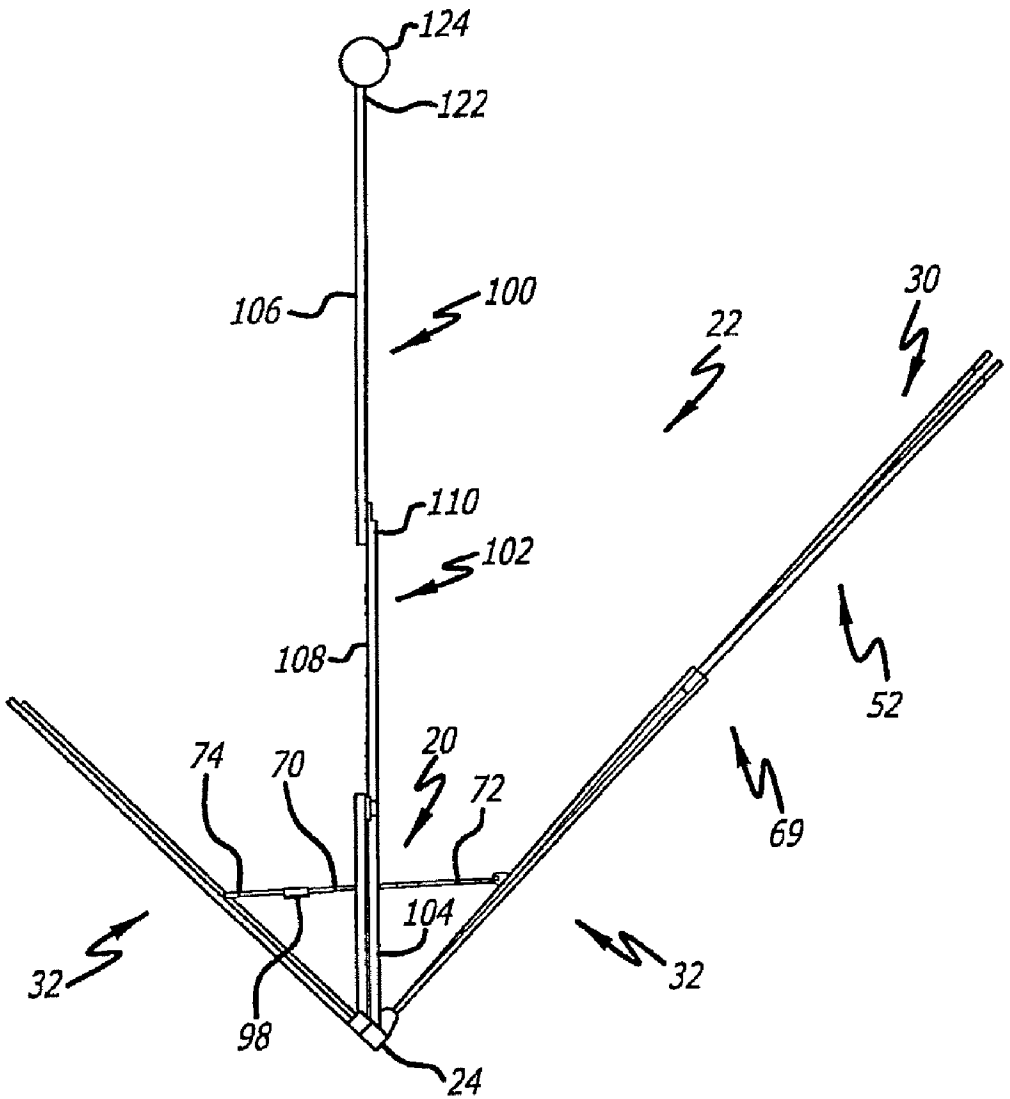
FIG. 3 is a top plan view of the corner portion of the corner portion of a framework of a canopy shelter of FIG. 1.
Figure 5:
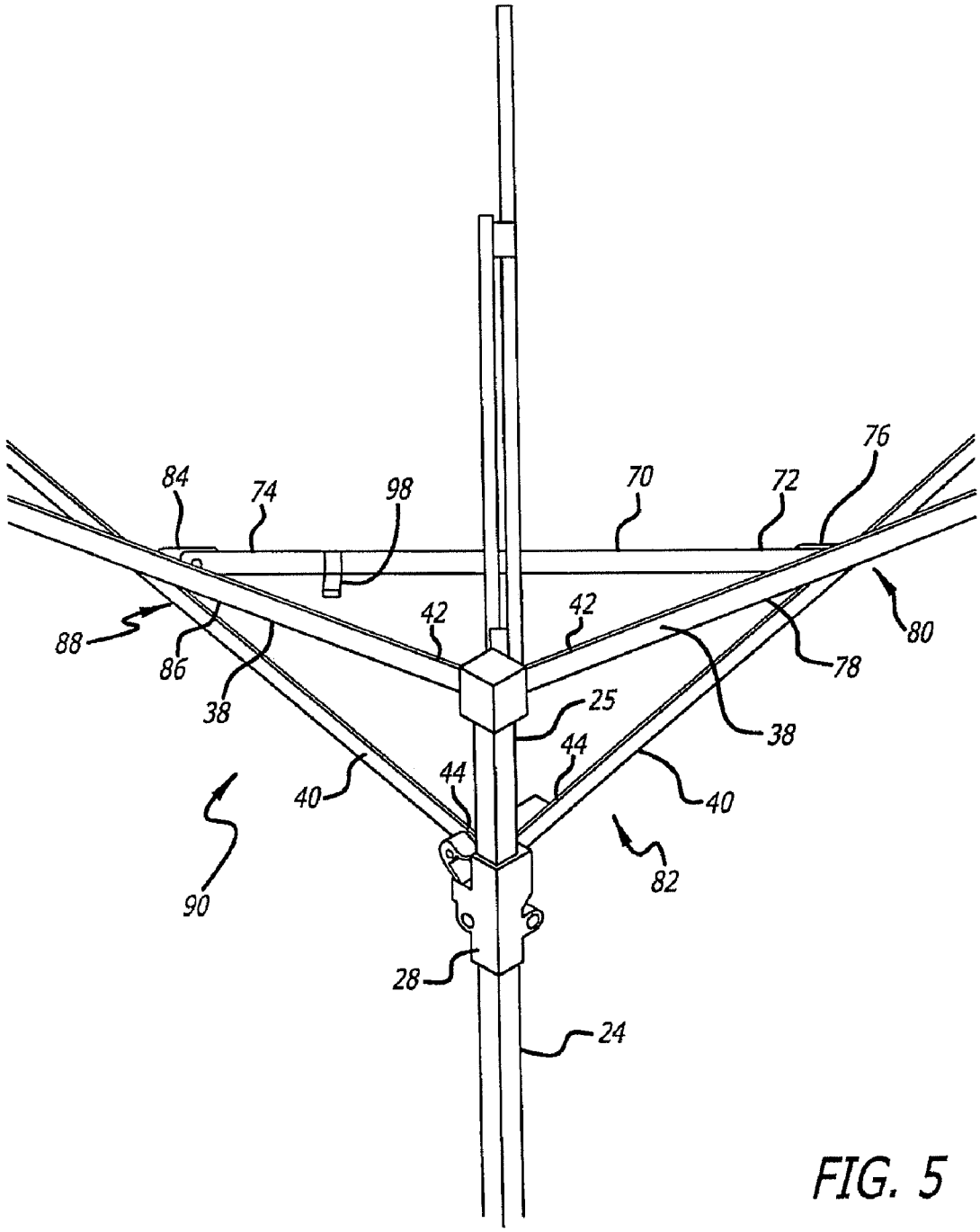
FIG. 5 is an enlarged top outside perspective view of the corner portion of a framework of a canopy shelter of FIG. 1.
Figure 6:
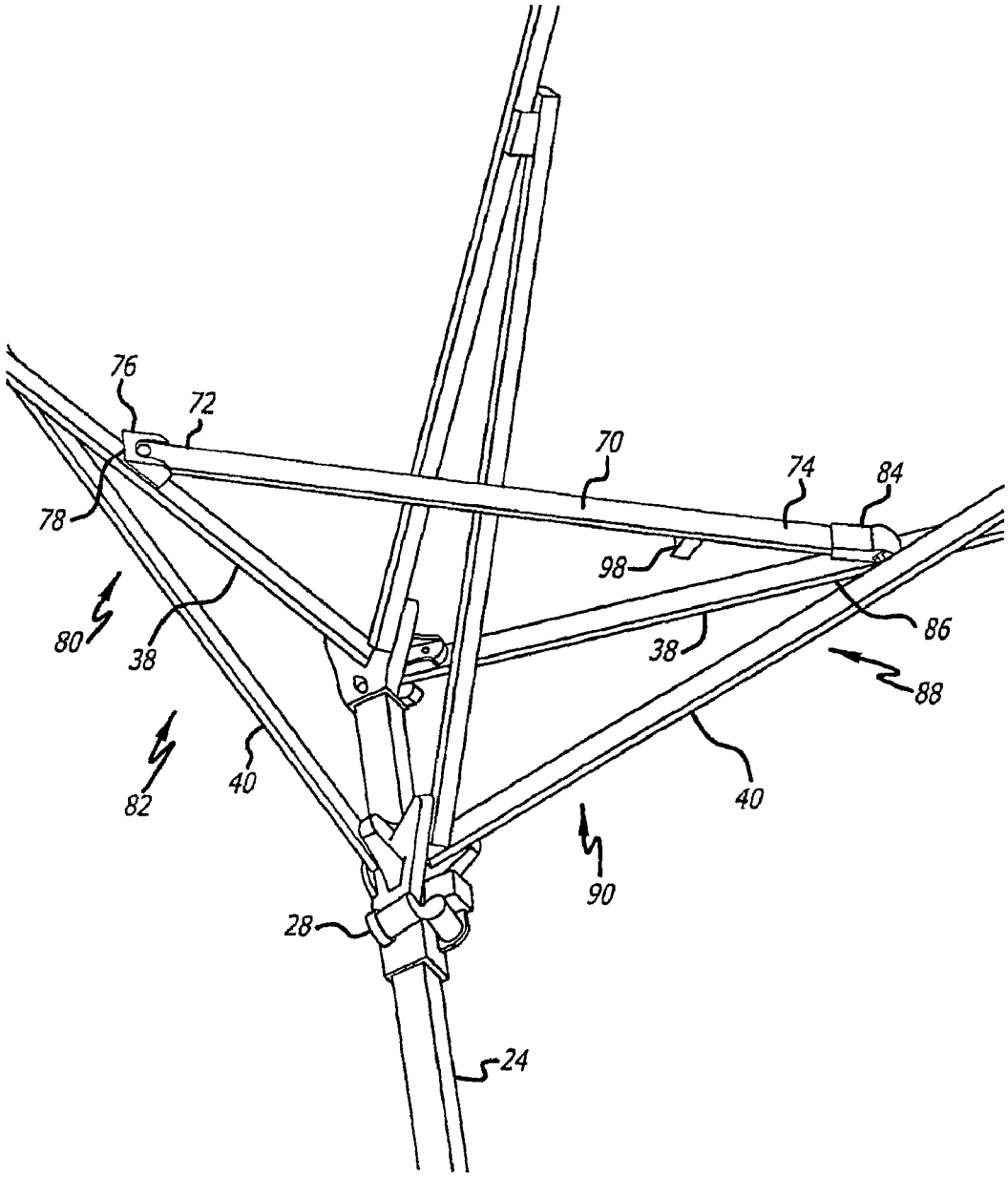
FIG. 6 is an enlarged bottom inside perspective view of the corner portion of a framework of a canopy shelter of FIG. 1.
Figure 7:
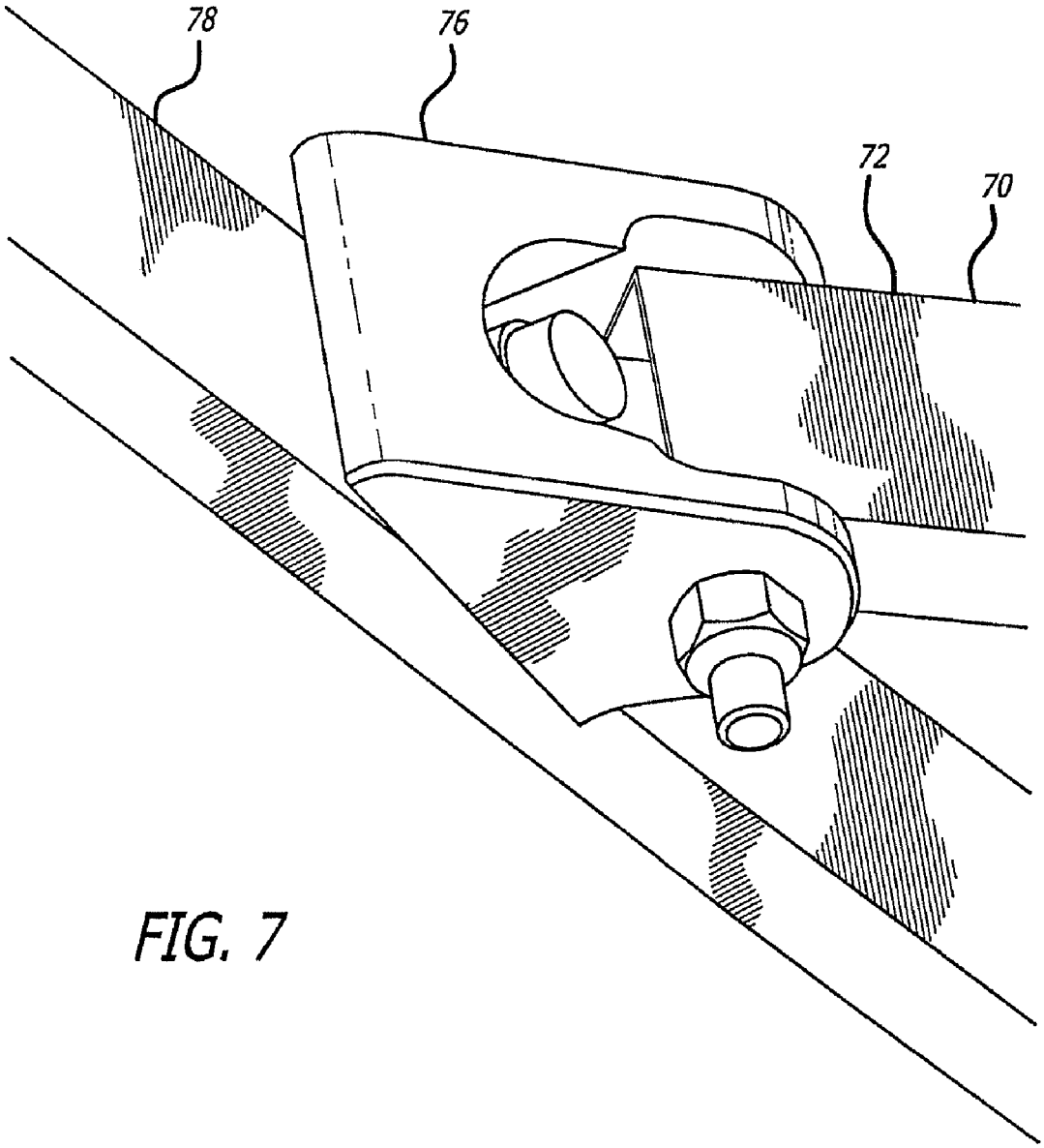
FIG. 7 is an enlarged perspective view of the swivel bracket of the support truss tube member of the corner brace of FIG. 1.
Figure 8:
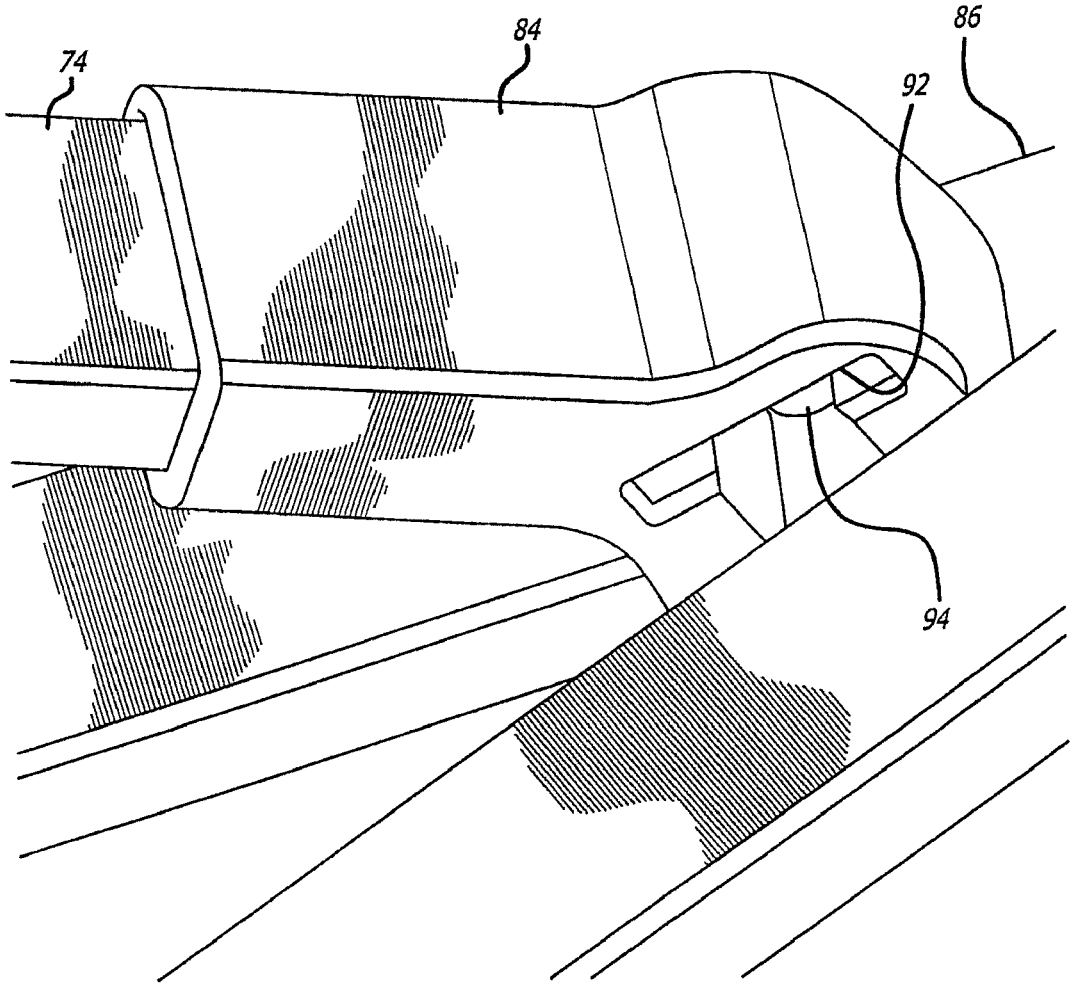
FIG. 8 is an enlarged perspective view of the support truss end fitting of the support truss tube member of the corner brace of FIG. 1.
Figure 9:
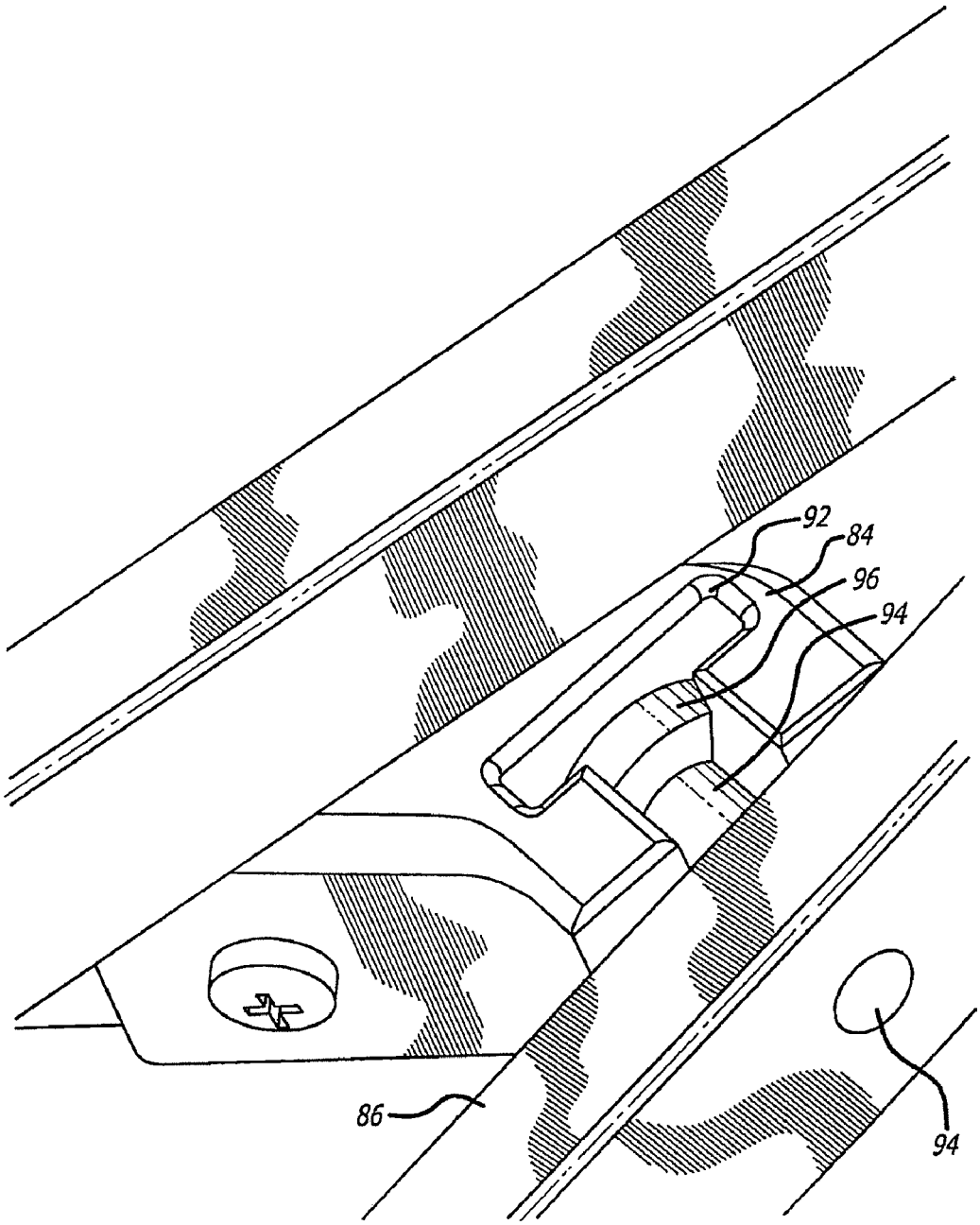
FIG. 9 is an enlarged bottom perspective view of the support truss end fitting of the support truss tube member of the corner brace of FIG. 1.
Figure 10:
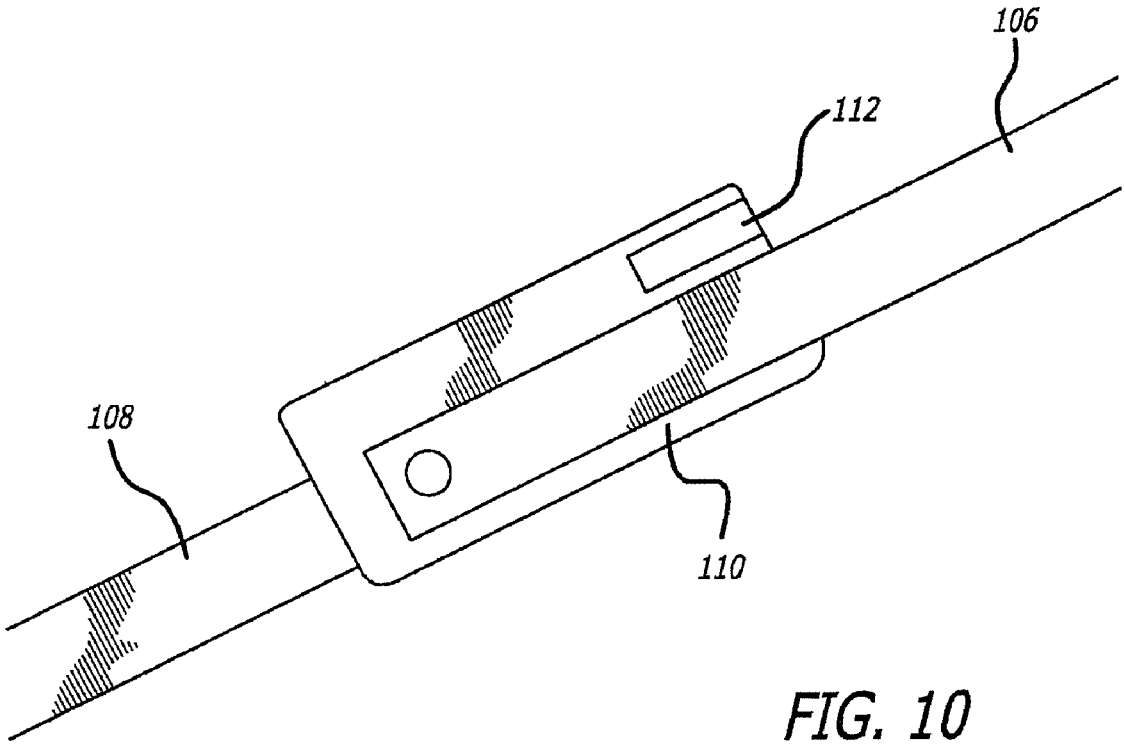
FIG. 10 is an enlarged perspective elevational view of the over-center spacer of the peak beam member of the canopy framework support assembly of the framework of a canopy shelter of FIG. 1.
Figure 11:
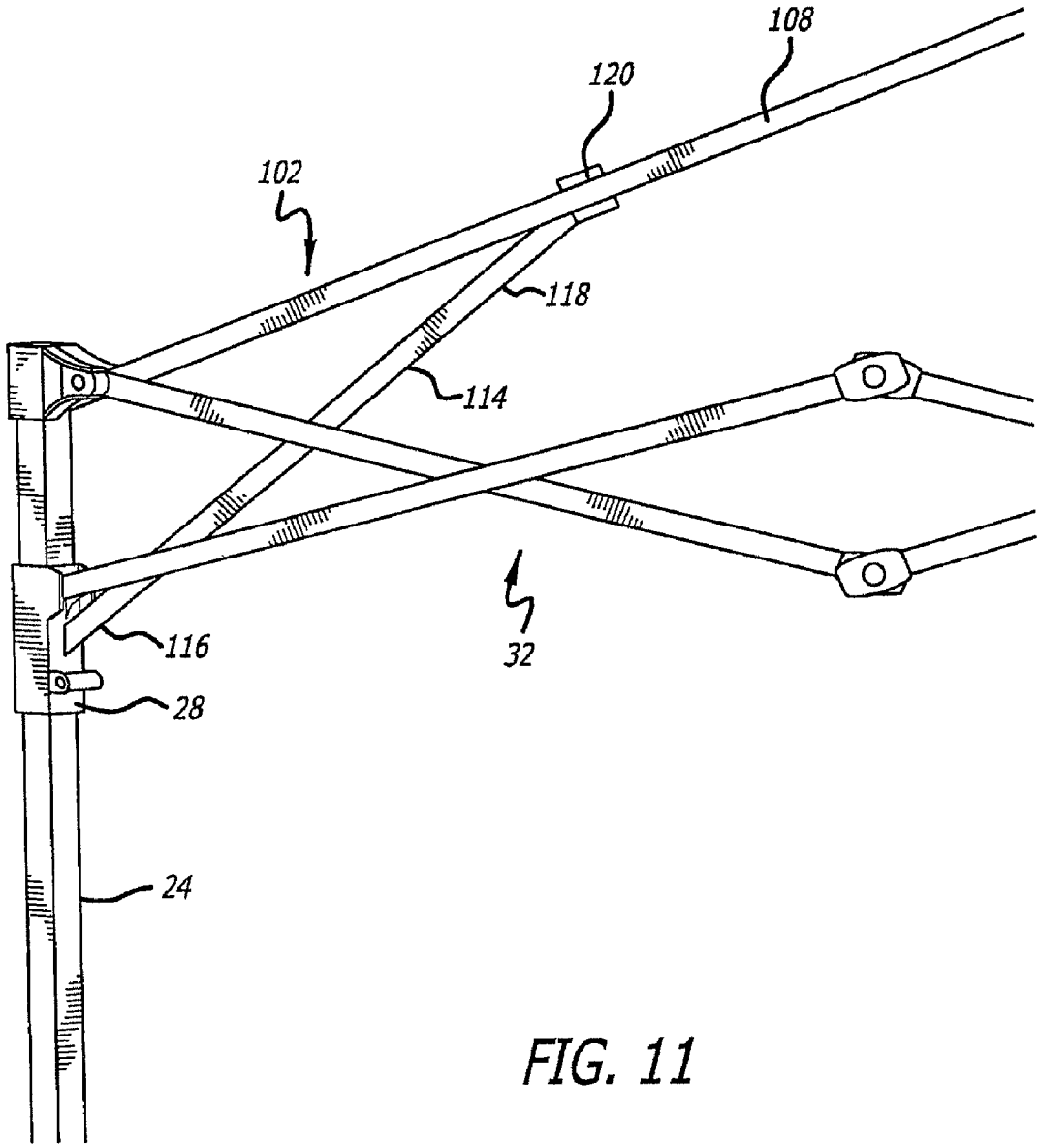
FIG. 11 is an enlarged side elevational view of the corner portion shown in FIG. 4.
Figure 12:
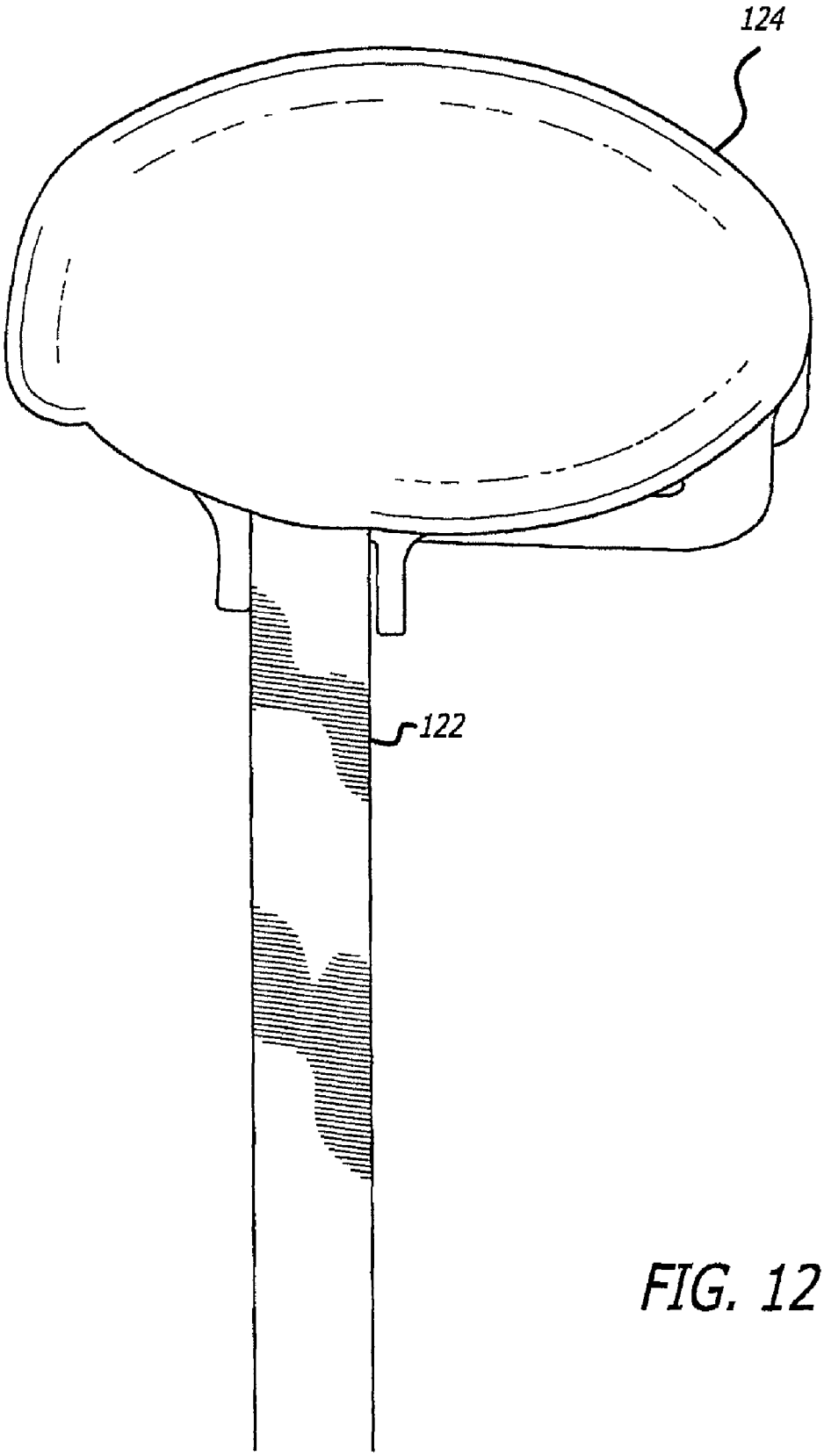
FIG. 12 is an enlarged top perspective view of the central peak hub assembly of the framework of a canopy shelter of FIG. 1.

As is illustrated in FIGS. 1-4, In order to provide additional support and reinforcement for side of the framework forming the wide, clear span 69 across the middle of the framework, the corner brace assembly of the present invention includes a support truss tube member 70 having a first end 72 and a second end 74. Referring to FIGS. 5-9, the first end of the support truss tube member is pivotally connected to a support truss swivel bracket or universal joint 76 that is in turn rotatably connected to an outer section 78 of the first link member of a first outer truss 80 on one side 82 of the leg for rotational movement with respect to the first link member, so that the support truss tube member is capable of pivoting, reciprocal movement and rotational movement with respect to the first link member of the first outer truss 80. The second end of the support truss tube member includes a support truss end fitting 84 that is removably connected to an outer section 86 of the first link member of a second outer truss 88 on the other side 90 of the leg. As is illustrated in FIGS. 7 and 8, the support truss end fitting includes a slot 92, such as a T-shaped slot, for receiving a pin or bolt 94 with a correspondingly similar configuration, mounted to and extending from the first link member of the second outer truss, and typically having an enlarged head 96 spaced apart from the second outer truss, allowing the support truss tube member to be rotated to slide the slot of the support truss end fitting over the extending pin on the first link member of the second outer truss, to removably connect the adjacent outer trusses at the leg together when the framework is in the extended configuration as shown. As is shown in FIGS. 3 and 5-6, the support truss tube member of the corner brace assembly may optionally include a support truss clip 98 adapted to snap fit to one of the link members of the framework when the support truss end fitting is disconnected from the first link member of the second outer truss and the framework of the canopy shelter is to be folded and collapsed, such as for transporting or storing the canopy shelter.

Figure 4:
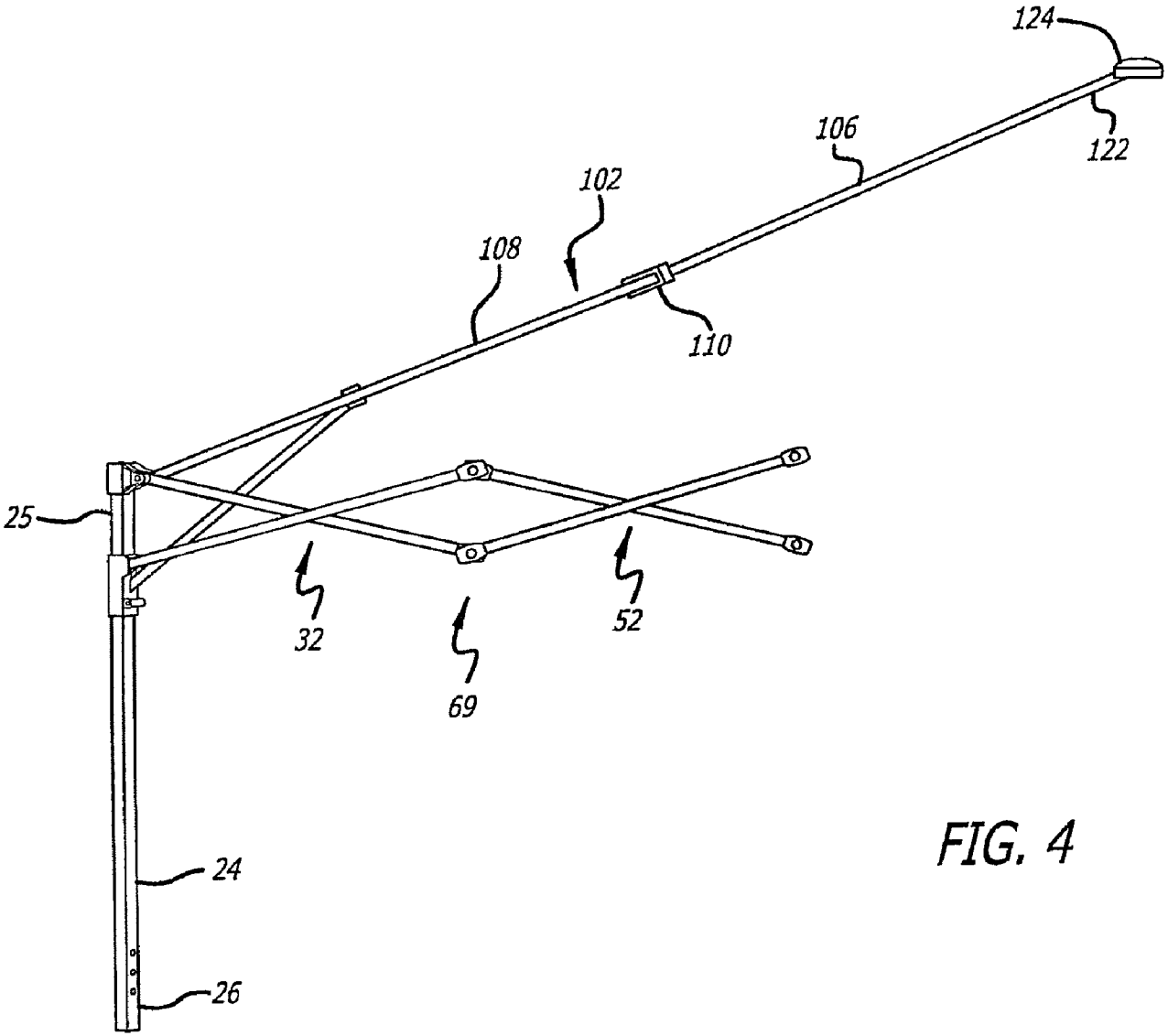
FIG. 4 is a side elevational view of the corner portion of a framework of a canopy shelter of FIG. 1.

In another presently preferred aspect, as is illustrated in FIGS. 1-4 and 10-12, the canopy shelter framework includes a canopy framework support assembly 100 including a peak beam member 102 having an outer end 104 pivotally mounted to the leg to extend across the shelter and movable between a lowered position (not shown) and a raised, upwardly extending position. Referring to FIGS. 3 and 4, each of the pole members typically comprises an inner peak beam tube section 106 and an outer peak beam tube section 108 that are pivotally joined together through an over-center spacer 110. The over-center spacer advantageously includes a locking flange 112 allowing the inner peak beam tube section to rotate about the over-center spacer from a collapsed position folded against the outer peak beam tube section to an unfolded, extended position shown in FIG. 10 and braced against the locking flange.

With reference to FIGS. 3-7 and 11, the canopy framework support assembly may also include a support strut member 114 with an outer end 116 pivotally mounted to the leg below the peak beam member. In a presently preferred aspect, the support strut member is pivotally mounted to the slider member. The support strut member has an inner end 118 with a support bracket 120 pivotally connected to the outer peak beam member to support the peak beam member in a raised, upwardly extending position as shown. As is illustrated in FIGS. 1-4 and 12, the inner end 122 of the peak beam member is pivotally connected to a central peak hub assembly 124, which is adapted to be connected to a plurality of other peak beam members of the framework of the canopy shelter. A canopy cover (not shown) may be placed over the canopy framework support assembly secured to the tops of the legs of the canopy shelter.

It will be apparent from the foregoing that while particular forms of the invention have been illustrated and described, various modifications can be made without departing from the spirit and scope of the invention. Accordingly, it is not intended that the invention be limited, except as by the appended claims.

I claim:

1. In a framework of a quickly erectable canopy shelter, the framework of the canopy shelter including a leg and a perimeter truss assembly connected to leg having an upper end and a lower end, a slider member slidably mounted to the leg, the perimeter truss assembly including first and second outer trusses of pairs of link members connected to the leg, each pair of link members of the first and second outer trusses including a first link member and a second link member pivotally connected together, said first link member having an outer end pivotally connected to the upper end of the leg, and said second link member having an outer end pivotally connected to the slider member, the improvement of a corner brace assembly comprising:

a corner brace mounting pin mounted to and extending from an outer section of the first link member of the second outer truss; and a support truss tube member having a first end and a second end, the first end of the support truss tube member being rotatably connected to an outer section of the first link member of the first outer truss on one side of the leg for rotational movement with respect to the first link member, and the second end of the support truss tube member including a support truss end fitting, said support truss end fitting including a slot for removably receiving the corner brace mounting pin to be removably connected to said outer section of the first link member of the second outer truss on the other side of the leg to removably connect the first and second outer trusses together.

2. The corner brace assembly of claim 1, further comprising a canopy framework support assembly including a peak beam member having an inner end and an outer end pivotally mounted to the leg to extend across the shelter, and wherein the peak beam member includes an inner peak beam tube section and an outer peak beam tube section pivotally joined together through an over-center spacer.

3. The corner brace assembly of claim 2, wherein said over-center spacer includes a locking flange allowing the inner peak beam tube section to rotate about the over-center spacer to an extended position braced against the locking flange.

4. The corner brace assembly of claim 2, wherein the inner end of the peak beam member is pivotally connected to a central peak hub assembly.

5. The corner brace assembly of claim 2, further comprising a support strut member having an inner end and an outer end, the outer end being pivotally mounted to the leg below the peak beam member, the support strut member being pivotally mounted to the slider member.

6. The corner brace assembly of claim 5, wherein the inner end of the support strut member comprises a support bracket pivotally connected the peak beam member to support said peak beam member.

7. The corner brace assembly of claim 1, wherein said corner brace mounting pin comprises an enlarged head spaced apart from the second outer truss.

8. The corner brace assembly of claim 1, wherein the support truss tube member of the corner brace includes a support truss clip adapted to snap fit to one of the link members of the framework of the canopy shelter.

9. The corner brace assembly of claim 1, wherein at least one of the outer trusses of pairs of link members is connected to a middle truss pair of link members.

* * * * *